US010385572B2

(12) United States Patent
Granovsky

(10) Patent No.: US 10,385,572 B2
(45) Date of Patent: Aug. 20, 2019

(54) SHEET MATERIAL FOR ROOFING WITH WATER-BASED ADHESIVE BACK COATING

(71) Applicant: ATLANTIC COATED PAPERS LTD. / PAPIER COUCHES D'ATLANTIC LTEE, Whitby (CA)

(72) Inventor: David Granovsky, Toronto (CA)

( * ) Notice: Subject to any disclaimer, the term of this patent is extended or adjusted under 35 U.S.C. 154(b) by 0 days.

(21) Appl. No.: 15/595,442

(22) Filed: May 15, 2017

(65) Prior Publication Data

US 2017/0328067 A1 Nov. 16, 2017

Related U.S. Application Data

(60) Provisional application No. 62/336,303, filed on May 13, 2016.

(51) Int. Cl.

| | |
|---|---|
| ***E04D 5/06*** | (2006.01) |
| ***E04D 5/12*** | (2006.01) |
| ***E04D 5/14*** | (2006.01) |
| ***E04D 12/00*** | (2006.01) |
| *D03D 1/00* | (2006.01) |

(52) U.S. Cl.

CPC ..... *E04D 5/06* (2013.01); *E04D 5/12* (2013.01); *E04D 5/148* (2013.01); *E04D 12/002* (2013.01); *D03D 1/0035* (2013.01); *D10B 2505/20* (2013.01); *E04D 5/14* (2013.01)

(58) Field of Classification Search

CPC ..... E04D 5/06; E04D 12/002; E04D 5/12; E04D 5/148; E04D 5/14; D10B 2505/20; D03D 1/0035; E04G 2021/248; B32B 2419/06

USPC ..... 52/408; 442/38, 43, 49, 185, 189, 398, 442/411; 428/195.1, 40.1, 41.8, 202, 220, 428/57, 110, 131, 137, 172

See application file for complete search history.

(56) References Cited

U.S. PATENT DOCUMENTS 2,380,460 A * 7/1945 North ..... E04D 5/142 52/420
3,541,745 A * 11/1970 Probst ..... E04D 1/26 52/105
3,763,609 A * 10/1973 Probst ..... E04D 1/26 52/105
4,087,577 A * 5/1978 Hendrickson ..... B29C 70/22 428/110
4,606,968 A * 8/1986 Thornton ..... A41D 31/0066 139/425 R
4,666,761 A * 5/1987 Stamper ..... B32B 27/12 428/215
4,844,958 A * 7/1989 Chapman ..... B05D 1/26 428/36.1
5,071,699 A * 12/1991 Pappas ..... B65D 88/165 383/108

(Continued)

*Primary Examiner* — James M Ference

(74) *Attorney, Agent, or Firm* — Benoit & Cote, Inc.; C. Marc Benoit

(57) ABSTRACT

A sheet material for roofing to be installed on a roof under an overlayment comprising a closed-weave woven having a top side and a back side; a thermoplastic layer affixed on the top side; and a water-based adhesive coating affixed on the back side. The sheet material is manufactured as a roll in which the thermoplastic layer isolates the water-based adhesive coating from an immediate environment when the sheet material is in a roll form.

19 Claims, 10 Drawing Sheets

(56) References Cited

U.S. PATENT DOCUMENTS 5,518,799 A * 5/1996 Finestone ..... B32B 27/10 428/131
6,308,482 B1 * 10/2001 Strait ..... B32B 27/12 428/57
6,645,336 B1 * 11/2003 Albertone ..... B32B 27/12 156/247
6,701,685 B2 3/2004 Rippey
6,869,661 B1 * 3/2005 Ahr ..... B32B 15/14 428/137
6,901,712 B2 * 6/2005 Lionel ..... E04D 12/002 156/71
6,925,766 B2 * 8/2005 Di Pede ..... B32B 3/30 52/408
7,354,877 B2 * 4/2008 Rosenberger ..... A41D 31/00 442/194
7,607,271 B2 10/2009 Griffin et al.
9,314,994 B2 * 4/2016 Strait ..... B32B 5/024
9,982,437 B2 * 5/2018 Barrego ..... E04D 12/002
2003/0054127 A1 * 3/2003 Heifetz ..... B29C 63/0017 428/40.1
2003/0070391 A1 * 4/2003 Tachauer ..... A44B 18/0049 52/745.21
2004/0146681 A1 * 7/2004 Naipawer, III ..... C09J 7/22 428/40.1
2004/0197547 A1 * 10/2004 Bristow ..... B32B 27/32 428/325
2005/0126102 A1 * 6/2005 Swann ..... E04D 5/12 52/518
2005/0202197 A1 * 9/2005 Mohseen ..... B32B 11/00 428/40.1
2005/0210808 A1 * 9/2005 Larson ..... B32B 27/12 52/555
2006/0127627 A1 * 6/2006 Larson ..... E04D 5/10 428/40.1
2007/0281119 A1 * 12/2007 Di Stefano ..... E04D 12/002 428/40.1
2008/0020662 A1 * 1/2008 Strait ..... B32B 5/26 442/43
2008/0026663 A1 * 1/2008 Zhang ..... B32B 11/04 442/398
2008/0028708 A1 * 2/2008 Albora ..... E04D 12/002 52/408
2008/0029210 A1 * 2/2008 Swei ..... B32B 27/08 156/272.2
2008/0152867 A1 * 6/2008 Di Pede ..... B32B 3/085 428/141
2009/0107073 A1 * 4/2009 Kalkanoglu ..... B32B 15/08 52/411
2009/0193743 A1 * 8/2009 Wiercinski ..... E04D 12/002 52/408
2009/0214830 A1 * 8/2009 Ito ..... B32B 5/18 428/172
2009/0277126 A1 * 11/2009 Wollert ..... B32B 7/02 52/741.1
2009/0291249 A1 * 11/2009 Mehta ..... E04D 5/10 428/86
2010/0203292 A1 * 8/2010 Seth ..... B32B 27/12 428/156
2010/0227103 A1 * 9/2010 Hohmann, Jr. ..... E04D 12/002 428/41.8
2010/0279096 A1 11/2010 Couch
2011/0009024 A1 * 1/2011 Clark ..... B32B 27/08 442/381
2011/0027536 A1 * 2/2011 Malpass ..... B32B 3/28 428/172
2011/0033685 A1 * 2/2011 Folkersen ..... B32B 11/02 428/219
2011/0165377 A1 * 7/2011 Binkley ..... B32B 5/22 428/150
2011/0311797 A1 * 12/2011 Worthen ..... B32B 27/08 428/220
2012/0065283 A1 * 3/2012 Adjei ..... D04H 1/541 521/62
2012/0094067 A1 * 4/2012 Nakae ..... B32B 5/22 428/138
2012/0141768 A1 * 6/2012 Gerace ..... B32B 27/304 428/304.4
2012/0148849 A1 * 6/2012 Fan ..... B32B 37/02 428/422
2012/0196496 A1 * 8/2012 Granovsky ..... D03D 15/0094 442/189
2013/0022779 A1 * 1/2013 Schroeer ..... E04B 1/625 428/99
2013/0139457 A1 * 6/2013 Coulton ..... E04B 1/625 52/309.1
2013/0157048 A1 * 6/2013 Rudolf ..... C09D 163/00 428/339
2013/0230702 A1 * 9/2013 O'Brien ..... E04D 12/002 428/195.1
2013/0244528 A1 * 9/2013 Lowery ..... B29C 70/026 442/411
2013/0247490 A1 * 9/2013 Strait ..... E04D 12/002 52/302.1
2014/0014711 A1 * 1/2014 Jutras ..... B65D 65/22 229/87.01
2014/0072751 A1 3/2014 Bradenburg
2014/0255649 A1 * 9/2014 Meyer ..... E04D 12/002 428/141
2015/0086747 A1 * 3/2015 Beuchel ..... B32B 21/08 428/106
2015/0099411 A1 * 4/2015 Yang ..... E04D 12/00 442/1
2015/0159305 A1 * 6/2015 Booth ..... D03D 15/0088 442/189
2016/0047126 A1 * 2/2016 Chen ..... B32B 5/024 428/167
2016/0123015 A1 * 5/2016 Granovsky ..... B32B 38/06 428/141
2016/0207283 A1 * 7/2016 Wang ..... B32B 5/02
2016/0258164 A1 * 9/2016 Canales ..... E04D 5/00
2017/0328067 A1 * 11/2017 Granovsky ..... E04D 5/06
2018/0010021 A1 * 1/2018 Carl ..... B32B 7/12

* cited by examiner

SHEET MATERIAL FOR ROOFING WITH WATER-BASED ADHESIVE BACK COATING

CROSS-REFERENCE TO RELATED APPLICATION

This application claims priority from U.S. patent provisional application 62/336,303 filed May 13, 2016, the specification of which is hereby incorporated herein by reference in its entirety.

BACKGROUND

Field

The subject matter disclosed generally relates to materials for roof structures, and especially to weather-resistant barriers for roof structures.

(b) Related Prior Art

Roof structures for buildings typically include an underlayment positioned between a roof support deck and an overlayment. The overlayment, such as asphalt shingles, tiles, wooden shakes, slate tiles metal roofing, or the like is intended to provide protection from external weather conditions like wind, rainwater, and snowmelt. In order to further protect against moisture and other elements which may pass under the overlayment, the underlayment is installed over the roof deck and under the underlayment to provide an added waterproof barrier. The additional moisture protection provided by the underlayment is particularly necessary with tile roofs, where gaps often exist between the tiles where moisture can pass through. The underlayment also serves the function of providing a seal around roofing fasteners used to affix the tiles to the roof support deck.

Another problem with existing underlayments is that they are not stable (i.e., they can slip) when they are installed on the roof support deck. This can introduce unnecessary delays in the installation of the underlayments.

Another problem with the existing products is regarding the installation. Products for installation on a roof need additional fastening material (nails, staples, etc.) or require handling of garbage material (protective material, packaging material, etc.). Handling such a material on roofs increase the labor during installation. The additional fastening material, garbage material and tools required for installation also constitutes unnecessary hazard.

There is a need for improvements in roofing underlayments which provides easy and fast the installation of roofing underlayment.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

SUMMARY

One general aspect includes a sheet material for roofing to be installed on a roof under an overlayment, the sheet material including:—a closed-weave woven having a top side and a back side;—a thermoplastic layer affixed on the top side; and—a water-based adhesive coating affixed on the back side. The sheet material also includes where the sheet material is manufactured as a roll in which the thermoplastic layer isolates the water-based adhesive coating from an immediate environment when the sheet material is in a roll form. Other embodiments of this aspect include corresponding computer systems, apparatus, and computer programs recorded on one or more computer storage devices, each configured to perform the actions of the methods.

Implementations may include one or more of the following features. The sheet material where the water-based adhesive coating is affixed to the back side according to a pattern which is consistent across the back side. The sheet material where the water-based adhesive coating substantially covers entirely the back side. The sheet material where the sheet material includes a width and an edge portion along the width, further where the water-based adhesive coating is affixed to the back side according to a pattern which is consistent across the back side except for the edge portion. The sheet material for roofing where the closed-weave woven and the thermoplastic layer conform to an identical resin identification code (ric) for recycling purposes. The sheet material for roofing where the sheet material has a width, the sheet material further including an edge portion covering a portion of the width, the edge portion having a different characteristic relative to the water-based adhesive coating on a remaining portion of the back side. The sheet material for roofing where the different characteristic includes one of density of the water-based adhesive coating, nature of the water-based adhesive coating, and pattern of the water-based adhesive coating. The sheet material for roofing further includes another thermoplastic layer affixed on the back side before the water-based adhesive coating. The sheet material for roofing where at least one of the thermoplastic layers is vapor impermeable. The sheet material for roofing where at least one the thermoplastic layers is a film-forming polymer. The sheet material for roofing where at least one the thermoplastic layers includes at least one of: polyethylene and polypropylene. The combination where the sheet material is manufactured as a roll in which the thermoplastic layer isolates the water-based adhesive coating from an immediate environment when the sheet material is in a roll form. The combination where the water-based adhesive coating is affixed to the back side according to a pattern which is consistent across the back side. The combination where the water-based adhesive coating substantially covers entirely the back side. The combination where the sheet material includes a width and an edge portion along the width, further where the water-based adhesive coating is affixed to the back side according to a pattern which is consistent across the back side except for the edge portion. The assembly where the water-based adhesive coating is affixed to the back side according to a pattern which is consistent across the back side. The assembly where the water-based adhesive coating substantially covers entirely the back side. The assembly where the sheet material includes a width and an edge portion along the width, further where the water-based adhesive coating is affixed to the back side according to a pattern which is consistent across the back side except for the edge portion. Implementations of the described techniques may include hardware, a method or process, or computer software on a computer-accessible medium.

One general aspect includes a combination for installation on a roof structure including:—an overlayment; and—a sheet material between the roof structure and the overlayment, the sheet material including:—a closed-weave woven having a top side and a back side;—a thermoplastic layer affixed on the top side; and—a water-based adhesive coating affixed on the back side. The combination also includes where, when the combination is installed on the roof structure, the back side adheres to the roof structure and the top side is disposed under the overlayment. Other embodiments of this aspect include corresponding computer systems, apparatus, and computer programs recorded on one or more computer storage devices, each configured to perform the actions of the methods.

Implementations may include one or more of the following features. The combination where the sheet material is manufactured as a roll in which the thermoplastic layer isolates the water-based adhesive coating from an immediate environment when the sheet material is in a roll form. The combination where the water-based adhesive coating is affixed to the back side according to a pattern which is consistent across the back side. The combination where the water-based adhesive coating substantially covers entirely the back side. The combination where the sheet material includes a width and an edge portion along the width, further where the water-based adhesive coating is affixed to the back side according to a pattern which is consistent across the back side except for the edge portion. The assembly where the water-based adhesive coating is affixed to the back side according to a pattern which is consistent across the back side. The assembly where the water-based adhesive coating substantially covers entirely the back side. The assembly where the sheet material includes a width and an edge portion along the width, further where the water-based adhesive coating is affixed to the back side according to a pattern which is consistent across the back side except for the edge portion. Implementations of the described techniques may include hardware, a method or process, or computer software on a computer-accessible medium.

One general aspect includes an assembly including a plurality of lengths of sheet material from a roll, the plurality of lengths of sheet material for installation on a roof structure in side-by-side and partially overlapping manner, the sheet material including:—a closed-weave woven having a top side and a back side. The assembly also includes—a thermoplastic layer affixed on the top side. The assembly also includes—a water-based adhesive coating affixed on the back side. The assembly also includes where, in the roll, the thermoplastic layer isolates the water-based adhesive coating from an immediate environment. The assembly also includes where the sheet material is adapted to be unrolled for installation over the roof structure exposing the water-based adhesive coating for adherence to the roof structure. Other embodiments of this aspect include corresponding computer systems, apparatus, and computer programs recorded on one or more computer storage devices, each configured to perform the actions of the methods.

Implementations may include one or more of the following features. The assembly where the water-based adhesive coating is affixed to the back side according to a pattern which is consistent across the back side. The assembly where the water-based adhesive coating substantially covers entirely the back side. The assembly where the sheet material includes a width and an edge portion along the width, further where the water-based adhesive coating is affixed to the back side according to a pattern which is consistent across the back side except for the edge portion. Implementations of the described techniques may include hardware, a method or process, or computer software on a computer-accessible medium.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

There is disclosed herein various embodiments of a sheet material for roofing.

The following terms are first defined.

The term "closed-weave woven" is intended to mean yarns or threads that are normally tightly interlaced at a right angle to form a fabric or a sheet material. The method in which these yarns or threads are interwoven affects the characteristics of the fabric or of the sheet material. The yarns or threads that are tightly interlaced may also be at an angle different than the right angle. Normally, "closed-weave woven" means that there is no space between the yarns or threads.

The term "thermoplastic layer" is intended to mean an elastic and flexible layer, made of a thermoplastic material, to be affixed to at least one of the front and back sides of a closed-weave woven. The "thermoplastic layer" may provide a weather-resistant barrier which prevents moisture and other external elements from passing through the sheet material.

The term "stick" or "to stick" is intended to mean "to adhere", "to affix", "to remain in place", "to cling", but not necessarily in permanent fashion. In the present document, the water-based adhesive coating provides more "stickiness" or is "stickier" than the surface on which it is installed; that is, the surface on which it is installed is more slippery if it does not have the water-based adhesive coating that if it does. Furthermore, the "stickiness" is stronger or greater in the direction parallel to the coating that in the direction that is normal to the coating.

Figure 2A:
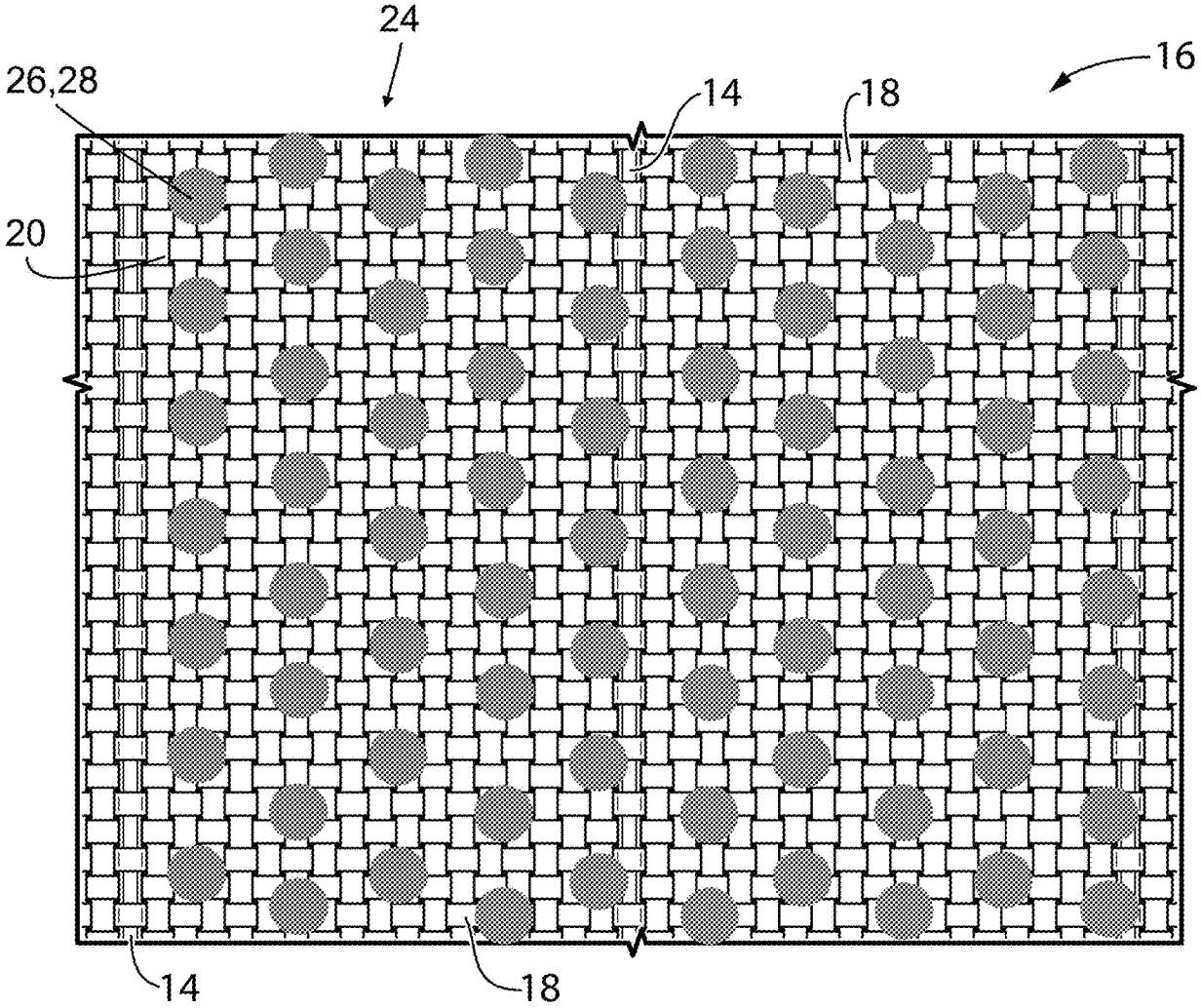
FIGS. 2*a-b* are bottom views of the back side of the closed-weave woven of the sheet material for roofing showing different patterns for the adhesive coating in accordance with different embodiments.
Figure 2B:
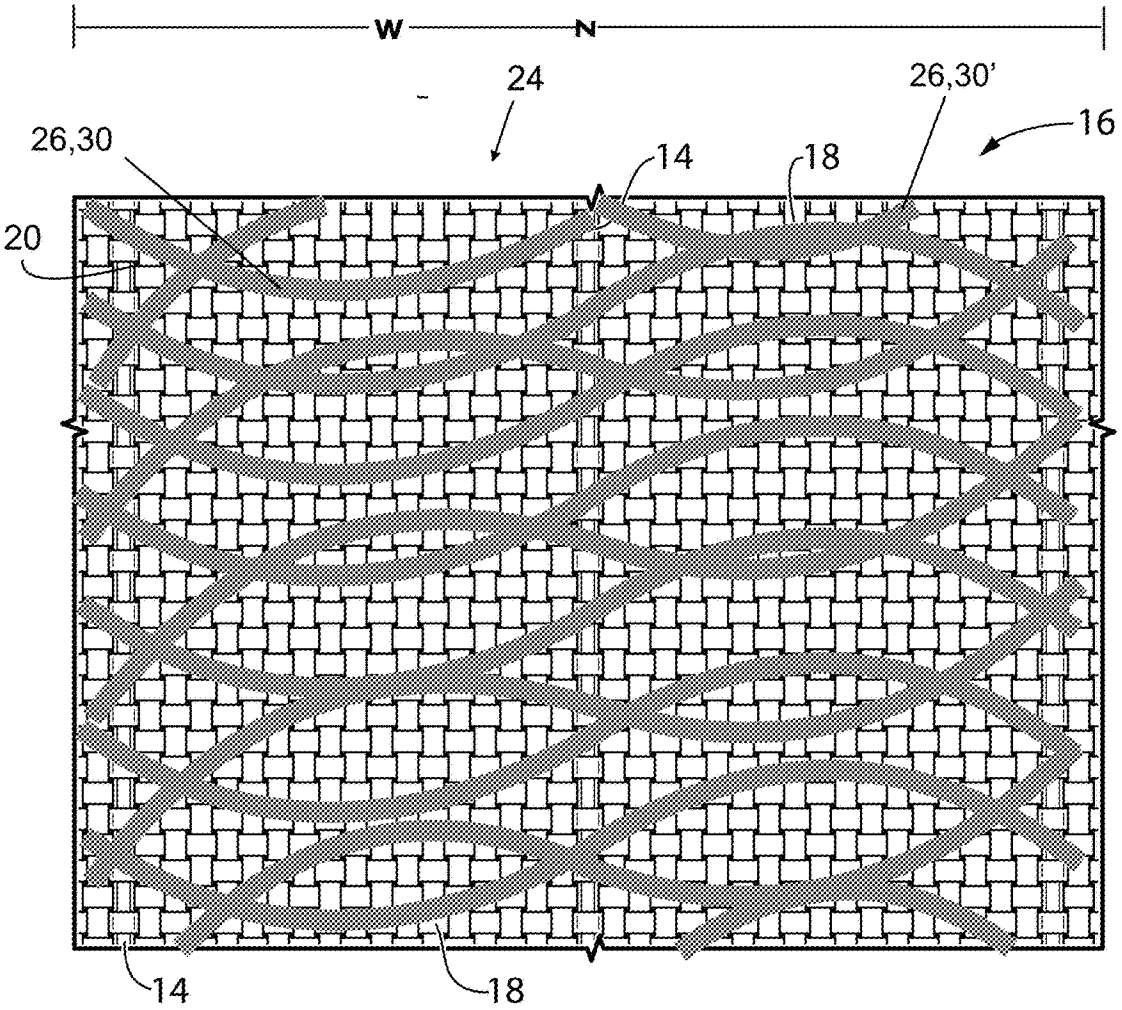

Referring now to FIGS. 2*a* and 2*b*, there are shown bottom views of the back side 24 of the sheet material for roofing 10. As illustrated, the back side 24 features an adhesive coating 26 made of a water-based compound. The water-based adhesive coating 26 provides an adhesive characteristic that will make the sheet material for roofing 10 stick to a surface (e.g., the roof support deck) by installing the back side 24 of the sheet material for roofing 10 on a surface.

According to an embodiment illustrated on FIG. 2*a*, the adhesive coating 26 is applied on the back side 24 in a series of equidistant circular spots 28 forming a pattern. In this embodiment, the pattern is consistent throughout the entire back side 24 (i.e., the size and distance between the spots is the same on the entire surface). The size of the circular spots is variable. According to another embodiment, the pattern may vary along the back side 24. However, in a preferred embodiment, the adhesive coating pattern presents an adhesive coating 26 in substantially all areas of the back side 24; i.e., an adhesive coating 26 is present in the middle of the surface as well as on the edge portions.

According to other embodiments, the adhesive coating 26 may consist of circular spots of different diameters, disposed according to another configuration, or a different shape (e.g., square, triangle, etc.). According to another embodiment, the adhesive coating 26 may also be realized as a uniform coating. According to another alternative embodiment, the adhesive coating 26 may consist in a series of equidistant or not equidistant straight stripes or alternatively shaped stripes such as wave-shaped stripes 30, and they may have substantially parallel path with or without crossing, or may cross to form a grid or a web. Width of the areas covered by the adhesive coating 26 and space between areas covered with the adhesive coating 26 may vary. FIG. 2*b* illustrates such an embodiment with a first series of wave-shaped parallel stripes 30 and a second series of de-phased stripes 30' crossing the stripes 30 of the first series.

The proportion of the back side 24 covered with the adhesive coating 26 varies between about 15% and 100% of the surface of the entire back side 24 of the sheet material for roofing 10. According to an embodiment, the adhesive coating 26 occupies more than 30% of the surface of the back side 24. According to an embodiment, the adhesive coating 26 occupies more than 35% of the surface of the back side 24. According to an embodiment, the adhesive coating 26 occupies more than 40% of the surface of the back side 24. According to an embodiment, the adhesive coating 26 occupies more than 45% of the surface of the back side 24. According to an embodiment, the adhesive coating 26 occupies more than 50% of the surface of the back side 24. According to an embodiment, the adhesive coating 26 occupies more than 55% of the surface of the back side 24. According to an embodiment, the adhesive coating 26 occupies more than 60% of the surface of the back side 24. According to an embodiment, the adhesive coating 26 occupies more than 65% of the surface of the back side 24. According to an embodiment, the adhesive coating 26 occupies more than 70% of the surface of the back side 24. According to an embodiment, the adhesive coating 26 occupies more than 75% of the surface of the back side 24. According to an embodiment, the adhesive coating 26 occupies more than 80% of the surface of the back side 24. According to an embodiment, the adhesive coating 26 occupies more than 85% of the surface of the back side 24. According to an embodiment, the adhesive coating 26 occupies more than 90% of the surface of the back side 24. According to an embodiment, the adhesive coating 26 occupies more than 95% of the surface of the back side 24. According to an embodiment, the adhesive coating 26 occupies 100% of the surface of the back side 24.

According to an embodiment, the proportion of the back side 24 covered with the adhesive coating 26 varies depending on sections (e.g., the edges or edge portions) relative to the width (FIG. 2*b*) of the sheet material for roofing 10. According to an embodiment, at least one edge portion of the sheet material for roofing 10 relative to its width is more densely coverage by the adhesive coating 26.

According to an embodiment, the edge portion covers more than 5% of the width of the sheet material for roofing 10. According to an embodiment, the edge portion covers more than 10% of the width of the sheet material for roofing 10. According to an embodiment, the edge portion covers more than 15% of the width of the sheet material for roofing 10. According to an embodiment, the ratio of coverage with the adhesive coating 26 on the edge portion versus on the center portion of the sheet material for roofing 10 is above 2 to 1. According to an embodiment, the ratio of coverage with the adhesive coating 26 on the edge portion versus on the center portion of the sheet material for roofing 10 is above 3 to 1. According to an embodiment, the ratio of coverage with the adhesive coating 26 on the edge portion versus on the center portion of the sheet material for roofing 10 is above 5 to 1.

According to one embodiment, the nature of the adhesive coating 26 of the edge portions is different from the nature of the adhesive coating 26 outside the edge portions, with the side-edge adhesive coating being for adhering to the top side 22 of the sheet material for roofing 10 wherein installed in an overlapping manner.

According to an embodiment, the adhesive coating 26 is selected such that it is compatible with a protective layer with which it interacts upon being rolled (e.g. spooled) and therefore, the protective layer acts as a weather protective barrier prior to installation (e.g., the thermoplastic layer 12 on the top side 22, as further discussed below). The adhesive coating 26 is therefore fully workable when the sheet material 10 is unrolled and the adhesive coating 26 is exposed. According to an embodiment, the adhesive coating 26 is selected to be active upon contact with an activation ingredient, for instance water.

Figure 1A:
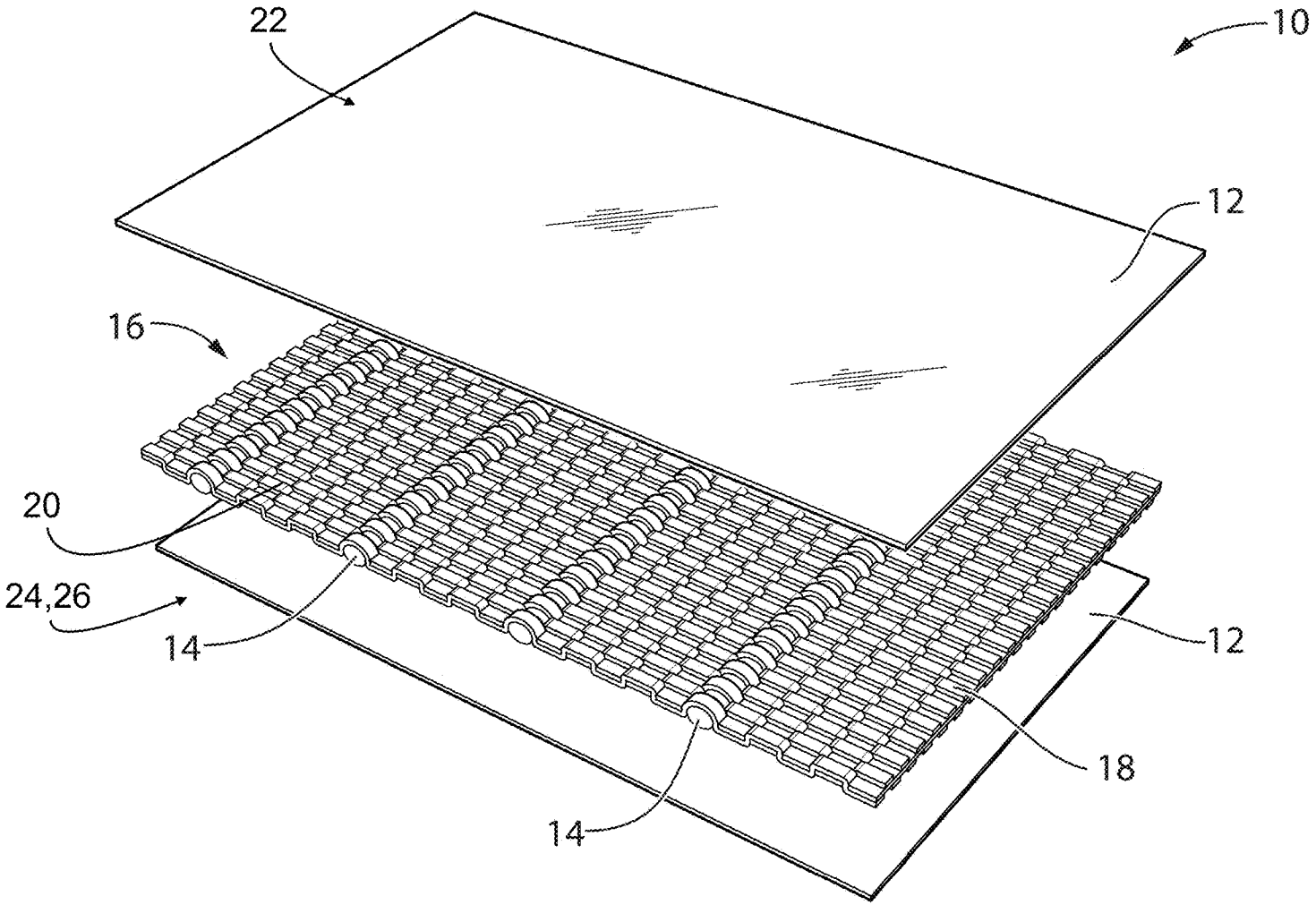
FIG. 1*a* is an exploded, perspective view of the sheet material for roofing in accordance with an embodiment.
Figure 1B:
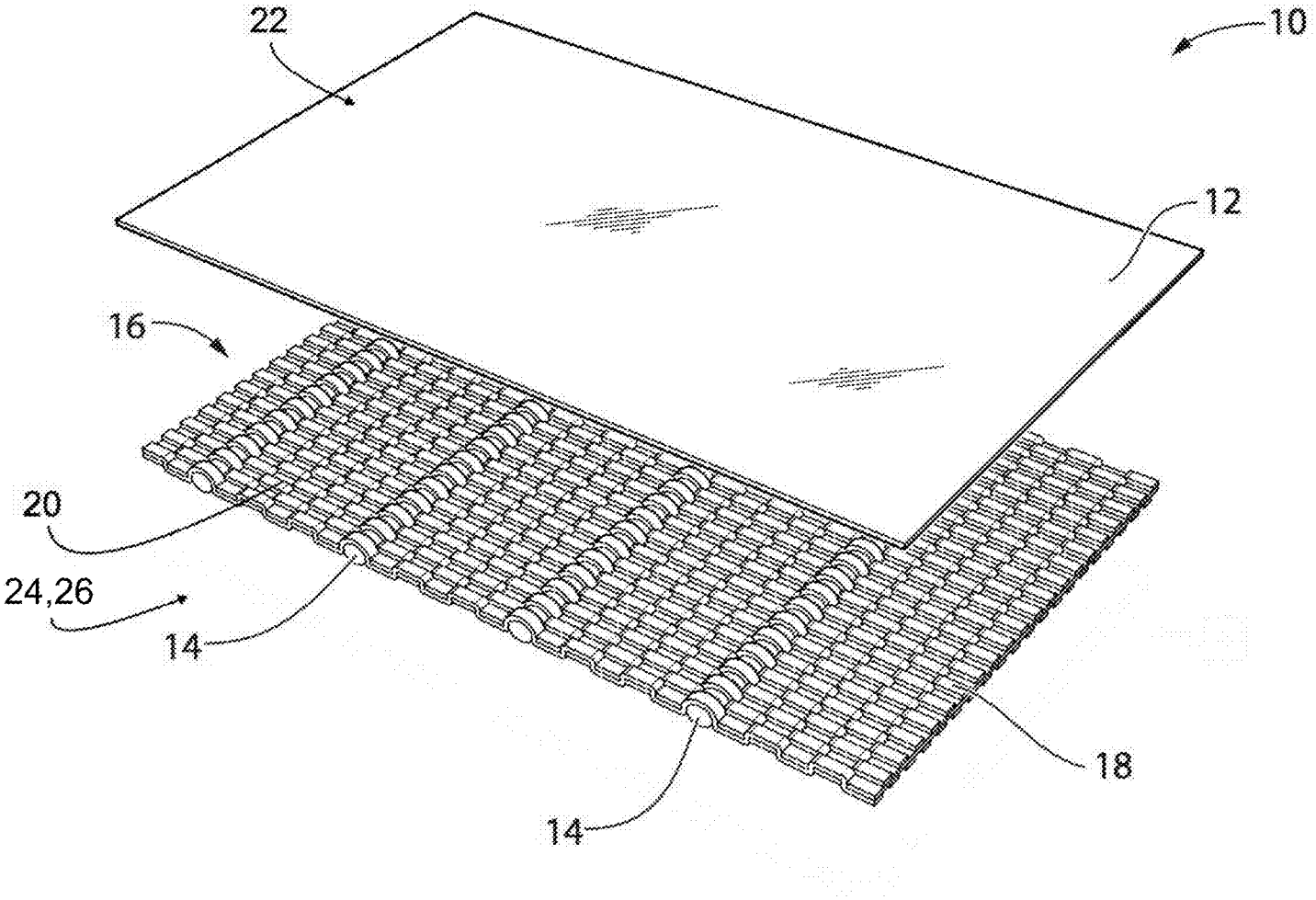
FIG. 1*b* is an exploded, perspective view of the sheet material for roofing in accordance with another embodiment.

Referring to FIGS. 1*a* and 1*b*, there is shown an exploded, perspective view of a sheet material for roofing 10 with water-based adhesive back coating in accordance with an embodiment. The sheet material for roofing 10 is made of a closed-weave woven 16. Normally, the closed weave woven 16 is made of yarns 20, and more specifically of yarns of a first gauge 18 woven in two directions. More preferably, the two directions taken by the yarns of a first gauge 18 are perpendicular. According to an alternative embodiment as illustrated on FIGS. 1*a* and 1*b*, in one of the two directions, yarns of a first gauge 18 are replaced with yarns of a second larger gauge 14 at a regular interval. In accordance with an embodiment, the yarns of a first gauge 18 are substantially flat, but can adopt any other cross-sectional configurations.

Figure 1C:
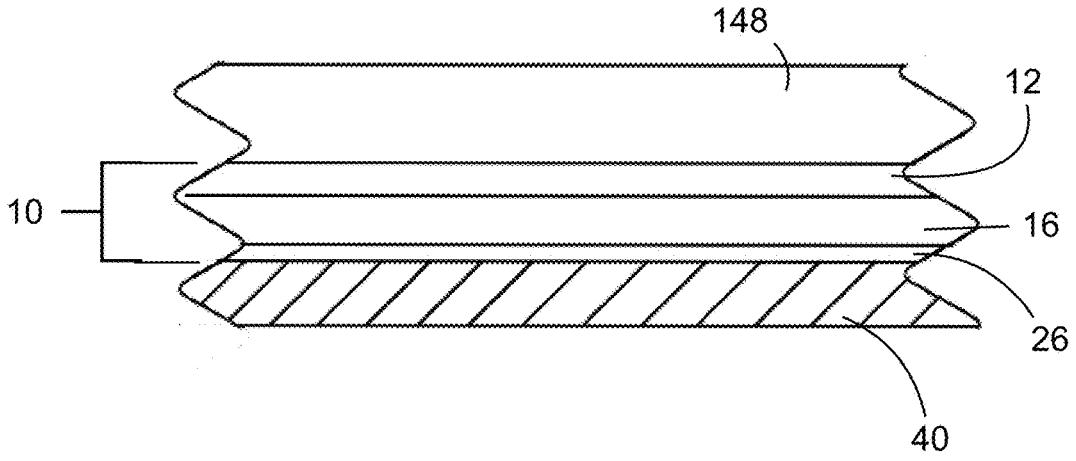
FIG. 1*c* is a cross-section view of the sheet material for roofing in accordance with an embodiment.

Still on FIG. 1*c*, there is shown an enlarged, fragmentary, cross-sectional view of the sheet material for roofing 10, in accordance with an embodiment. The sheet material for roofing 10 includes a closed-weave woven 16 having a thermoplastic layer 12 affixed to its top side 22. Preferably, the thermoplastic layers 12 are affixed to the top side 22 only of the closed-weave woven 16. Accordingly, an impermeable barrier is formed between the top side 22 and the back side 24 of the sheet material for roofing 10. Since only the top side 22 of the sheet material for roofing 10 is open to weather, and more specifically to rain and snow, the back side 24 remains protected from these weather elements. FIG. 1*c* also shows the overlayment 148 above the sheet material and the underlayment 40 below the sheet material 10.

According to embodiment, the sheet material for roofing 10 is manufactured in rolls 140 (see FIG. 4), with the adhesive coating 26 on the back side 24 of the sheet material for roofing 10. According to an embodiment, the nature of the adhesive coating 26 and of the thermoplastic layer 12 are selected for both the thermoplastic layers 12 isolating the adhesive coating 26 from the environment when the sheet material for roofing 10 is rolled, and for the adhesive coating 26 to stick temporarily to the thermoplastic layer 12, thereby providing an unaltered adhesive coating 26 once the thermoplastic layer 12 separates from the adhesive coating 26 (e.g. upon unrolling) on a section of the roll 140 of sheet material for roofing 10. Furthermore, since the thermoplastic layer 12 performs a protective function for the adhesive coating 26, no additional adhesive coating protective layer is necessary, decreasing the to-be-scrapped portion of the sheet material for roofing 10.

Still referring to FIG. 1, the closed-weave woven 16 is formed of yarns 20 (normally yarns of a first gauge 18 in combination or not with yarns of a second gauge 14) of material having a tensile strength sufficient to resist tearing when exposed to tensile loads from various directions.

According to an embodiment, the nature of the yarns 20 of the closed-weave woven 16 and of the thermoplastic layer 12 are selected to be in the same recycling category and accordingly able to be recycled using a common process. According to an embodiment, they conform to the #2 PEHD/HDPE or high-density polyethylene according to the Resin Identification Codes (RIC). Furthermore, the water-based adhesive coating 26 is further selected to not hinder the recycling process of the sheet material for roofing 10. Accordingly, the sheet material for roofing 10 is fully recyclable, generating no environmentally-harmful material.

According to an embodiment, any additional layer or coating added to the above closed-weave-woven 16, thermoplastic layer 12 and adhesive coating 26 are selected as either in the same recycling category or as not hindering the recycling process.

Figure 3:
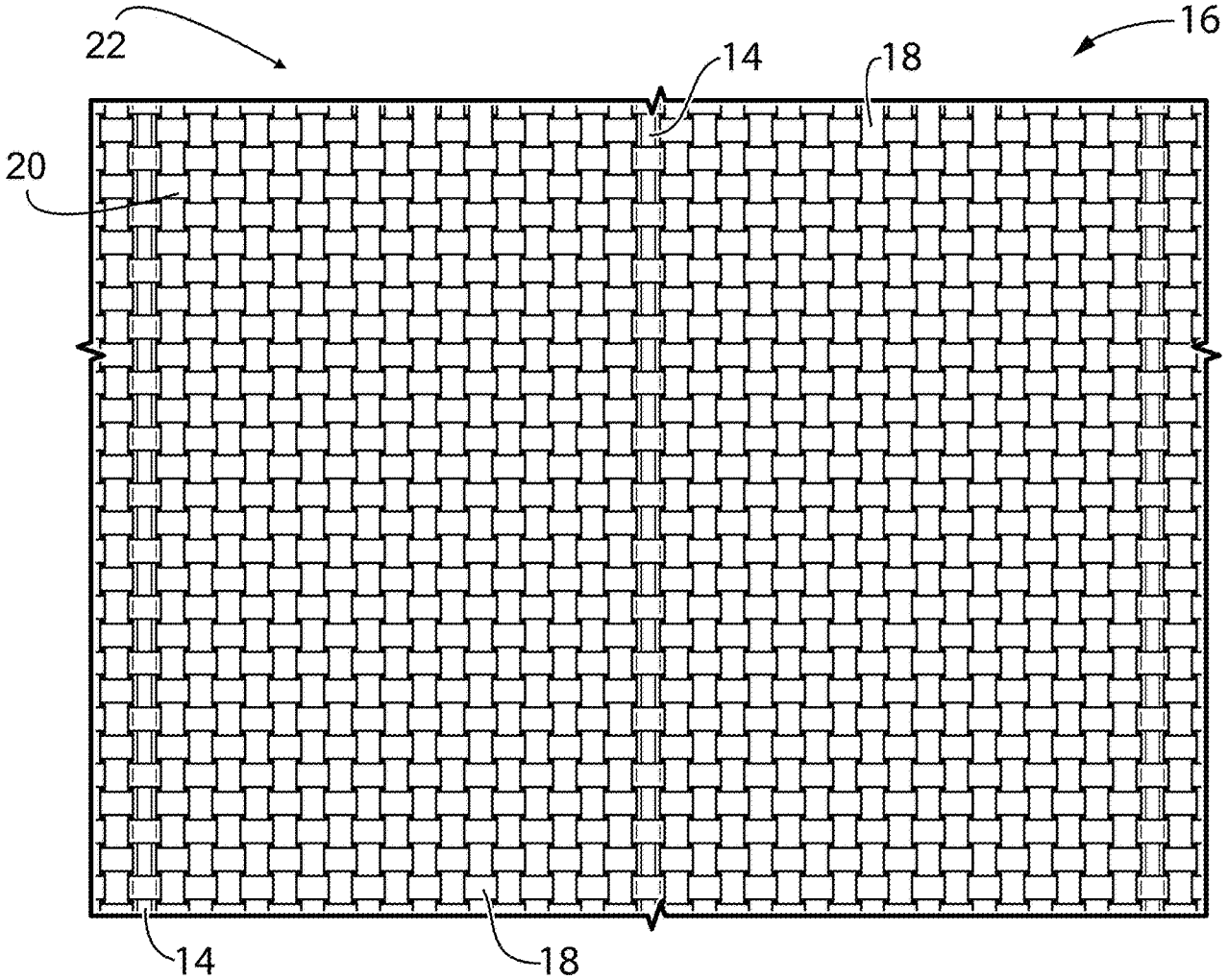
FIG. 3 is a top view of the top side of the closed-weave woven of the sheet material for roofing in accordance with an embodiment.

Referring now to FIG. 3, there are shown elevation views of the closed-weave woven 16 of the sheet material for roofing 10 in accordance with an alternative embodiment. As illustrated, a first group of yarns of the first gauge 18 are in a first direction, a second group of yarns of the first gauge 18 are in a second direction perpendicular to the first direction Regardless of the use of multiples types of yarns, the back side 24 features the water-based adhesive coating 26.

The yarns 20 of the closed-weave woven 16 may be formed of a thermoplastic polymer, such as polypropylene, polyethylene, polyester, nylon or other similar materials. However, it is to be noted that the yarns 20 of the closed-weave woven 16 may be of any suitable material that has strength sufficient to resist tearing when exposed to tensile loads from various directions.

The yarns 20 are interwoven as shown in FIG. 3, by way of example, to provide a closed-weave woven 16 having an improved tensile strength not achievable with solid film material. The orientation of the yarns 20 may also be selected to optimize their tensile strength.

The yarns of a first gauge 18 and the yarn of a second gauge 14 may comprise any cross-sectional shape and size, depending upon the desired tensile characteristics of the closed-weave woven 16. For example, the yarns of a first gauge 18 may be interwoven fibers as shown in FIG. 3, may be cross-laminated polyethylene tape, or may include any other interwoven configuration. The size of the yarn of the first gauge 18 may be approximately 800 Denier to 1,000 Denier. The same sizes of the yarns 20 apply when a single type of yarns 20 is used in the fabrication of the sheet material for roofing 10.

Referring back to FIG. 1, the thermoplastic layer 12 affixed to the top side 22 of the closed-weave woven 16 provide a weather-resistant barrier which prevents moisture and other external elements from passing through the sheet material for roofing 10. An exemplary embodiment for the thermoplastic layers 12 includes a layer of thermoplastic film which is extruded over the top side of the closed-weave woven 16.

The sheet material for roofing 10 is shown as having a thermoplastic layer 12 positioned over each side of the top side 22 and the back side 24 of the closed-weave woven 16. However, it is understood that certain applications may allow the closed-weave woven 16 to have only one of the top side 22 and the back side 24 on which is affixed a thermoplastic layer 12 while keeping the desired characteristics. The thermoplastic layer 12 may include polyethylene, polypropylene, or other similar thermoplastic polymers.

The sheet material for roofing 10 is formed by extruding layers of thermoplastic layer 12 over the closed-weave woven 16, but it is understood that the thermoplastic layers 12 may be affixed to the closed-weave woven 16 using an adhesive or any other manner of attachment.

Figure 7:
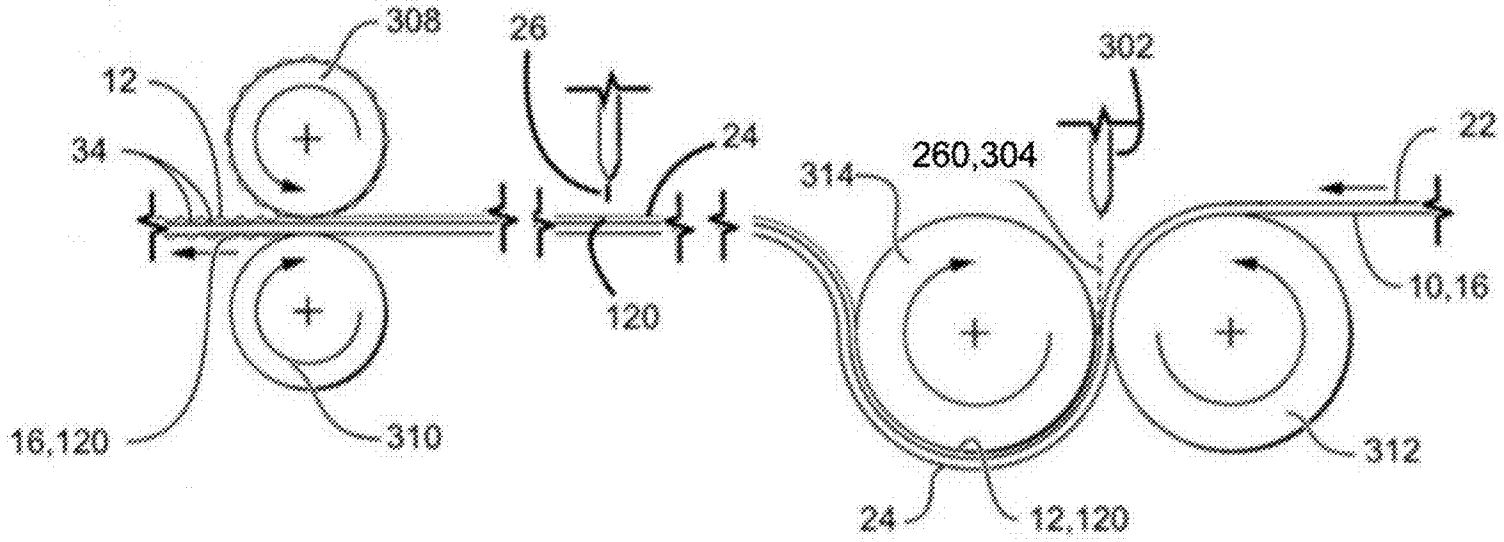
FIG. 7 illustrates a process for manufacturing a sheet material for roofing in accordance with another embodiment.

According to an embodiment, the water-based adhesive will be affixed to the back side 24 of the sheet material for roofing 10 using a die stamping/printing method (explained further in relation with FIG. 7).

It is to be noted that the thermoplastic layer 12 affixed on the top side 22 of the closed-weave woven 16 may differ from the thermoplastic layer 12 affixed on the back side 24 of the closed-weave woven 16. Selection of different compositions or characteristics for the thermoplastic layers 12 may be performed to optimize the sheet material for roofing 10 for particular applications.

The thermoplastic layers 12 may be variably pigmented to allow the color of the thermoplastic layers 12 to be selected based upon particular requirements. The thickness of the thermoplastic layers 12 is selected such that the sheet material for roofing 10 is flexible, whereby the flexible nature of the sheet material for roofing 10 allows it to be formed into rolls 140 and easily installed by simply unrolling the sheet material for roofing 10 over a roof support structure or the like.

According to an embodiment, the sheet material for roofing 10 is installed between a roof support structure/deck and an overlayment in order to provide a waterproof barrier for the roof structure. The sheet material for roofing 10 is normally intended to be self-adhesive to the roof structure, but may be additionally mechanically fastened to the roof rafters using nails or screws.

The sheet material for roofing 10 may be formed from a plurality of thermoplastic layers 12 having an improved resistance to deterioration from exposure to external elements, such as moisture and dirt, so that the sheet material for roofing 10 has an improved durability and longevity. Moreover, employing closed-weave woven 16 in the sheet material for roofing 10 provides an improved tensile strength capable of being walked upon without tearing when being installed on the roof. The closed-weave woven 16 further provides improved strength to resist tearing when exposed to external forces, such as collected moisture, wind, and other external forces.

As shown, the improved resistance to deterioration and tearing provided by the sheet material for roofing 10 improves the integrity and effectiveness of the weather-resistant barrier provided by the sheet material for roofing 10. By improving the longevity of the waterproof integrity of the sheet material for roofing 10 to more closely match the integrity of the entire roof structure, the longevity of the integrity of the entire roof structure is improved.

Figure 4:
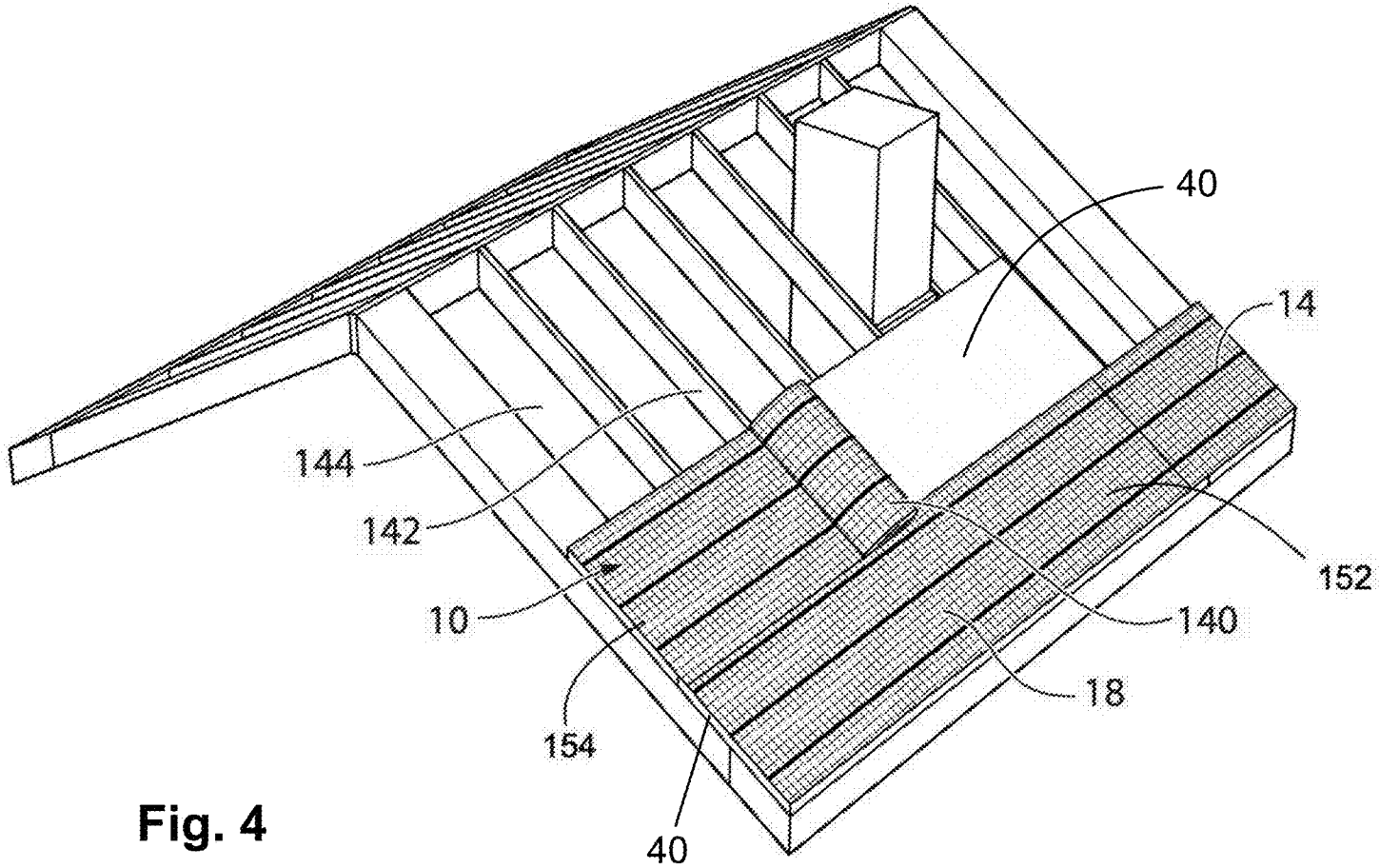
FIG. 4 is a perspective view of the sheet material for roofing being installed on an exemplary roof structure in accordance with an embodiment.

According to an embodiment, and referring now to FIG. 4, there is shown a perspective view of the sheet material for roofing 10 being installed on an exemplary roof structure in accordance with an embodiment. The sheet material for roofing 10 is to be installed between a roof support structure and an overlayment in order to provide a waterproof barrier for the roof structure. As shown, the sheet material for roofing 10 may be formed into rolls 140 which can be simply unrolled over the roof rafters 142 to allow for easy installation. Although not shown on FIG. 4, the roof structure normally includes an additional layer of panels (aka paneling) over the roof rafters 142. The panels may include various types of plywood, presswood, etc. The sheet material for roofing 10 sticks to the paneling through contact with the adhesive coating 26.

According to an embodiment, the rolls 140 are of a length allowing the whole width of a roof to be covered with the sheet material for roofing 10 without any interruption lengthwise. According strips of the sheet material for roofing 10 are installed bottom up, a bottom edge portion of the top strip 154 of sheet material for roofing 10 covering a top edge portion of the bottom strip 152.

Figure 5:
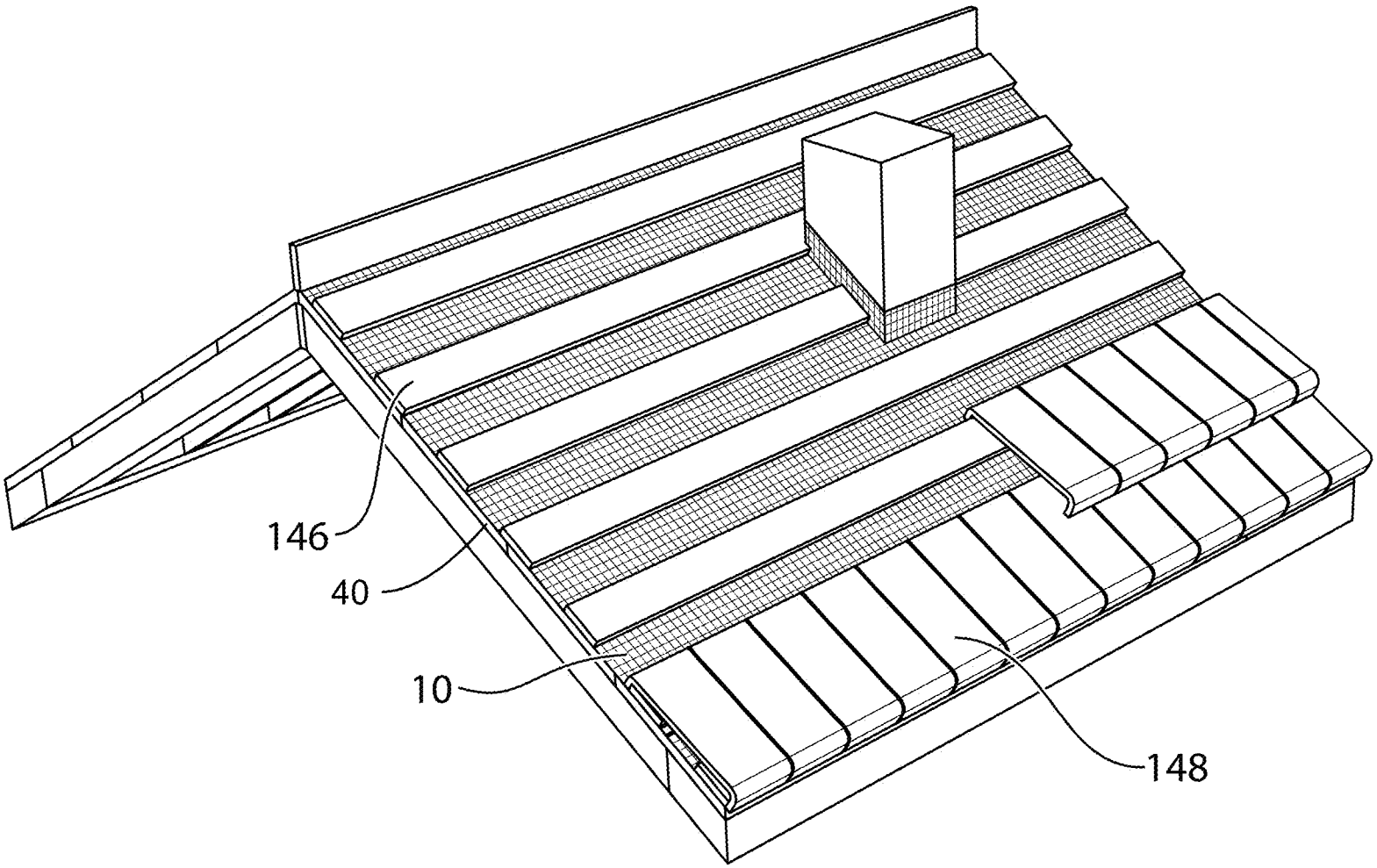
FIG. 5 is a perspective view showing the sheet material for roofing of FIG. 6 in a later stage of the installation process.
Figure 6:
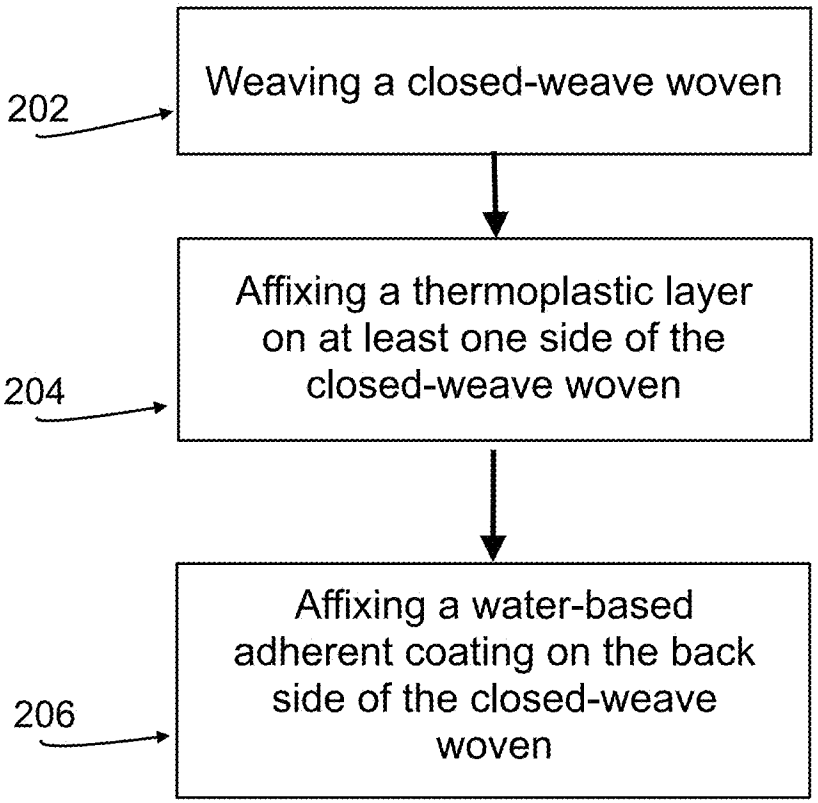
FIG. 6 illustrates a method for preparing a sheet material for roofing in accordance with an embodiment.

According to an embodiment, battens 146 are then fastened over the sheet material for roofing 10 and on the roof rafters 142, where the overlayment 148 is then attached to the battens 146, as shown in FIG. 5.

It is to be noted that illustration of the roof structure provided on FIGS. 4 and 5 is provided for explanation purpose only and does not limit the use of the different embodiments to such roofing structures. Furthermore, the roof structure, frequently if not normally, includes, over the roof rafters 142, wood boards, wood planks, plywood sheets or other alternative surface-closing material defining one or more continuous substantially continuous surfaces (e.g., paneling) on which to lay the sheet material for roofing 10 herein described before installing the overlayment 148. Accordingly, such roof structure provides a more important area for the water-based adhesive coating 26 to stick over the roof structure before installation of the overlayment 148.

According to another embodiment in relation with FIGS. 4 and 5, there is described a combination for installation on a roof structure that comprises the overlayment 148. The combination further comprises the closed-weave woven 16 for installation between the roof structure and the overlayment 148. The closed-weave woven 16 as described has a top side 22 and a back side 24. The thermoplastic layer 12 is affixed on the top side 22 of the closed-weave woven 16. The water-based adhesive coating 26 is affixed on the back side 24 of the sheet material for roofing 10. Therefore, when installing the sheet material for roofing 10, the back side 24 of the sheet material for roofing 10 is pressed against the roof structure, sticking to the roof structure. Afterwards, the overlayment 148 is installed over the top side 22 of the sheet material for roofing 10 to complete the roofing of the roof structure.

Still referring to FIGS. 4 and 5, according to another embodiment, an assembly is described comprising a plurality of side-by-side and slightly overlapping lengths of sheet material for roofing 10 from a roll 140. The lengths of sheet material for roofing 10 are adapted for installation on a roof structure. Upon installation, the back side 22 of the sheet material for roofing 10 is applied on the roof structure, thereby having the water-based adhesive coating 26, and accordingly the whole sheet material for roofing 10, sticking on the surface of the roof structure. Afterwards an overlayment 148 is installed over the sheet material for roofing 10 to complete the roofing of the roof structure.

According to another embodiment, there is provided a method 200 for preparing a sheet material for roofing 10. The method for preparing a sheet material for roofing 10 comprises the step 202 of weaving a closed-weave woven 16.

The method 200 for preparing sheet material for roofing 10 may further comprise the step 204 of affixing a thermoplastic layer 12 to at least one of a top side 22 and the back side 24 of the closed-weave woven 16 for providing a weather-resistant barrier. According to an embodiment, step 204 of affixing a thermoplastic layer 12 can be performed by extruding layers of thermoplastic layer 12 over the closed-weave woven 16

The method 200 for preparing a sheet material for roofing 10 further comprises the step 206 of affixing a water-based adhesive coating 26 on the back side 24 of the closed-weave woven 16 for providing a weather-resistant barrier. According to an embodiment, step 206 of affixing a water-based adhesive coating 26 on the back side 24 can be performed by using a roll on which a die having the selected pattern for the water-based adhesive coating is installed. The die will pick up (be dipped in or exposed to) the water-based adhesive and will roll on the back side 24 of sheet material for roofing 10 thereby transferring a coating of water-based adhesive thereto.

Referring to FIG. 7, there is provided a process for manufacturing the slip resistant sheet material for roofing 10. First, the closed-weave woven 16 is unwound into an unwinding machine for showing upwardly the top side 22 of the closed-weave woven 16. Next, a polymer film 304 is extruded through a heated die 302 to form a first thermoplastic layer 12. The first thermoplastic layer 12 bonds to the top side 22 of the closed-weave woven 16 at the nip point 260 where at least one of rollers 312, 314 is cooled for cooling the temperature of the closed-weave woven 16 which is being bonded with the first thermoplastic layer 12.

According to another embodiment (not shown), the closed-weave woven 16 is wounded and again unwound into the unwinding machine for showing upwardly the back side 24 of the closed-weave woven 16. Another polymer film 304 is then extruded through the heated die 302 to form the second plastic layer 120 covering the back side 24 of the closed-weave woven 16. The second thermoplastic layer 120 then bonds to the back side 24 of the closed-weave woven 16 at the nip point 306, where at least one of rollers 312, 314 is cooled for cooling the temperature of the closed-weave woven 16 which is being bonded with the second thermoplastic layer 120.

At this step, if necessary (not shown), the closed-weave woven 16 is wounded and again unwound into the unwinding machine for showing upwardly the back side 24 of the closed-weave woven 16.

A further step consists in affixing or applying the water-based adhesive coating 26 to the back side 24 of the sheet material for roofing 10 using a die stamping/printing method. According to embodiment, a non-contact affixing technique such as an adhesive spray technique or an adhesive jet technique may be used to affix the water-based adhesive coating 26. According to an embodiment (not shown), a contact-requiring technique such as stamping can be used to affix water-based adhesive coating 26 on the back side 24 (the closed-weave woven 16 or the second thermoplastic layer 120 when present) of the sheet material for roofing 10.

According to an embodiment, a printing process may take place during which printing is performed over the top side 22 of the manufactured sheet material for roofing 10. The printing process may consist in printing installation information, warranty information, and caution information to name a few on the top side 22 of the sheet material for roofing 10.

Optionally, at ambient temperature, the closed-weave woven 16 that can be extruded with first and/or second thermoplastic layers 12,120, passes through an engraved roller 308 and a backer roller 310. Using this process, the embossed pattern 34 is respectively cast into the first thermoplastic layer 12, the closed-weave woven 16 and alternatively, the second thermoplastic layer 120. Since the step of passing the closed-weave woven 16 through the engraved roller 308 and the backer roller 310 is performed once the closed-weave woven 16 is extruded with first and second thermoplastic layers 12,120, there is no need for one or both roller(s) 308, 310 to be temperature controlled to cool down the polymer film extrusion and engraved to provide the embossed pattern 34.

After these steps (not shown), the exiting sheet material for roofing 10 is fed to a roller for forming a manufactured roll 140 of the sheet material for roofing 10.

One must note that, according to embodiments, the step of affixing the adhesive coating 26, the step of printing the sheet material for roofing 10 and the step of embossing the sheet material for roofing 10 may be alternated. Furthermore, according to embodiments, the step of wounding and unwounding the sheet material for roofing 10 to present on top the desired face may be performed as many times as needed.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A sheet material for roofing to be installed on a roof under an overlayment, the sheet material comprising:
- a closed-weave woven having a top side and a back side;
- a thermoplastic layer affixed on the top side of the closed-weave woven; and
- a water-based self-adhesive coating directly affixed to the back side of the closed-weave woven,
- wherein the sheet material is manufactured as a roll in which the thermoplastic layer on the top side of the closed-weave woven isolates the water-based adhesive coating from an immediate environment when the sheet material is in the roll,
- wherein, in the roll, the thermoplastic layer isolates the water-based adhesive coating from an immediate environment, and
- wherein the sheet material is adapted to be unrolled for installation over the roof exposing the water-based adhesive coating for adherence to the roof.

2. The sheet material of claim 1, wherein the water-based adhesive coating is affixed to the back side of the closed-weave woven according to a pattern which is consistent across the back side of the closed-weave woven.

3. The sheet material of claim 1, wherein the water-based adhesive coating substantially covers entirely the back side of the closed-weave woven.

4. The sheet material of claim 1, wherein the sheet material comprises a width and an edge portion along the width, further wherein the water-based adhesive coating is affixed to the back side of the closed-weave woven according to a pattern which is consistent across the back side of the closed-weave woven except for the edge portion.

5. The sheet material for roofing of claim 1, wherein the closed-weave woven and the thermoplastic layer conform to an identical Resin Identification Code (RIC) for recycling purposes.

6. The sheet material for roofing of claim 1, wherein the sheet material has a width, the sheet material further comprising an edge portion covering a portion of the width, the edge portion having a different characteristic relative to the water-based adhesive coating on a remaining portion of the back side of the closed-weave woven.

7. The sheet material for roofing of claim 6, wherein the different characteristic comprises one of density of the water-based adhesive coating, nature of the water-based adhesive coating, and pattern of the water-based adhesive coating.

8. The sheet material for roofing of claim 1, further comprises another thermoplastic layer affixed on the back side of the closed-weave woven before the water-based adhesive coating.

9. The sheet material for roofing of claim 8, wherein at least one of the thermoplastic layers is vapor impermeable.

10. The sheet material for roofing of claim 8, wherein at least one the thermoplastic layers is a film-forming polymer.

11. The sheet material for roofing of claim 8, wherein at least one the thermoplastic layers comprises at least one of: polyethylene and polypropylene.

12. A combination for installation on a roof structure comprising:
- an overlayment; and
- a sheet material between the roof structure and the overlayment, the sheet material comprising:
- a closed-weave woven having a top side and a back side;
- a thermoplastic layer affixed on the top side of the closed-weave woven; and
- a water-based self-adhesive coating directly affixed to the back side of the closed-weave woven,
- wherein the sheet material is manufactured as a roll in which the thermoplastic layer on the top side of the closed-weave woven isolates the water-based adhesive coating from an immediate environment when the sheet material is in the roll,
- wherein, in the roll, the thermoplastic layer isolates the water-based adhesive coating from an immediate environment,
- wherein the sheet material is adapted to be unrolled for installation over the roof structure exposing the water-based adhesive coating for adherence to the roof structure, and
- wherein, when the combination is installed on the roof structure, the back side of the closed-weave woven adheres to the roof structure and the top side of the closed-weave woven is disposed under the overlayment.

13. The combination of claim 12, wherein the water-based adhesive coating is affixed to the back side of the closed-weave woven according to a pattern which is consistent across the back side of the closed-weave woven.

14. The combination of claim 12, wherein the water-based adhesive coating substantially covers entirely the back side of the closed-weave woven.

15. The combination of claim 12, wherein the sheet material comprises a width and an edge portion along the width, further wherein the water-based adhesive coating is affixed to the back side of the closed-weave woven according to a pattern which is consistent across the back side of the closed-weave woven except for the edge portion.

16. An assembly comprising a plurality of lengths of sheet material from a roll, the plurality of lengths of sheet material for installation on a roof structure in a side-by-side and partially overlapping manner, the sheet material comprising:

a closed-weave woven having a top side and a back side;

a thermoplastic layer affixed on the top side of the closed-weave woven; and a water-based self-adhesive coating directly affixed to the back side of the closed-weave woven, wherein, in the roll, the thermoplastic layer isolates the water-based adhesive coating from an immediate environment, and wherein the sheet material is adapted to be unrolled for installation over the roof structure exposing the water-based adhesive coating for adherence to the roof structure.

17. The assembly of claim 16, wherein the water-based adhesive coating is affixed to the back side of the closed-weave woven according to a pattern which is consistent across the back side of the closed-weave woven.

18. The assembly of claim 16, wherein the water-based adhesive coating substantially covers entirely the back side of the closed-weave woven.

19. The assembly of claim 16, wherein the sheet material comprises a width and an edge portion along the width, further wherein the water-based adhesive coating is affixed to the back side of the closed-weave woven according to a pattern which is consistent across the back side of the closed-weave woven except for the edge portion.

* * * * *